US008156708B2

(12) United States Patent
Moore et al.

(10) Patent No.: US 8,156,708 B2
(45) Date of Patent: Apr. 17, 2012

(54) MODULAR SYSTEM FOR CONTAINMENT OF FRAGMENTS AND DIFFUSION OF GASES FROM EXPLOSION

(75) Inventors: Thomas Z. Moore, San Antonio, TX (US); Walter M. Gray, San Antonio, TX (US)

(73) Assignee: Southwest Research Institute, San Antonio, TX (US)

( * ) Notice: Subject to any disclaimer, the term of this patent is extended or adjusted under 35 U.S.C. 154(b) by 267 days.

(21) Appl. No.: 12/639,080

(22) Filed: Dec. 16, 2009

(65) Prior Publication Data

US 2011/0139044 A1 Jun. 16, 2011

(51) Int. Cl.
*E04B 1/00* (2006.01)
*E04B 2/00* (2006.01)

(52) U.S. Cl. ..... 52/741.3; 52/506.06; 109/49.5

(58) Field of Classification Search ..... 52/380, 52/383, 410, 506.06, 799.13, 656.1, 659, 52/741.3, 799.12; 109/49.5, 80, 81, 82, 83, 109/84, 85
See application file for complete search history.

(56) References Cited

U.S. PATENT DOCUMENTS

| | | | | |
|---|---|---|---|---|
| 2,405,590 | A * | 8/1946 | Mason | 109/81 |
| 2,545,717 | A * | 3/1951 | Voigt | 47/18 |
| 4,325,309 | A * | 4/1982 | King et al. | 109/49.5 |
| 4,326,468 | A * | 4/1982 | King et al. | 109/49.5 |
| 5,608,989 | A * | 3/1997 | Behrens | 47/65.9 |
| 5,675,933 | A * | 10/1997 | Kawaguchi et al. | 47/65.8 |
| 6,393,776 | B1 * | 5/2002 | Waller et al. | 52/169.6 |
| 2008/0295445 | A1 * | 12/2008 | James | 52/741.3 |
| 2010/0199892 | A1 * | 8/2010 | Elliott et al. | 109/83 |
| 2011/0023759 | A1 * | 2/2011 | Waller | 109/79 |

* cited by examiner

*Primary Examiner* — Branon Painter
(74) *Attorney, Agent, or Firm* — Chowdhury & Georgakis, P.C.; Ann C. Livingston

(57) ABSTRACT

A system of gravel modules to be used atop a room or other enclosure in which there is a threat of explosion. Each module has a rigid metal box frame, which contains a two layers of gravel. The lower gravel layer is screen gravel, and a layer of graded gravel is above the screen gravel. The box frame has a lower and an upper criss-cross pattern of bridge cable. A stack of wire mesh and other supporting material is laid over the lower bridge cable to support the screen gravel, and more wire mesh is laid over the screen gravel to support the graded gravel. The depths and grades of gravel are selected according to the type potential explosion, in terms of explosive fragment sizes and the nature of any expanding gases.

15 Claims, 3 Drawing Sheets

MODULAR SYSTEM FOR CONTAINMENT OF FRAGMENTS AND DIFFUSION OF GASES FROM EXPLOSION

TECHNICAL FIELD OF THE INVENTION

This invention relates to ballistic containment systems, and more particularly to architectural structures used to construct rooms in which explosions are likely to occur.

BACKGROUND OF THE INVENTION

To avoid disaster, it is sometimes appropriate to provide a containment system for potential explosions, detonations, or other energetic events. The explosion may eject large and small objects and particles (referred to herein collectively as "fragments"), as well as expanding gases. The containment system should contain the exploding fragments and should allow the expanding gases to diffuse into the atmosphere.

More specifically, an energetic event, such as an explosion, can expel a wide range of fragments at a wide range of speeds. Relatively massive fragments, as large as 4.5 kg, can be expelled at speeds below 90 m/s. Lower mass fragments, less than 0.5 kg, can be expelled at speeds of 900 m/s.

One approach to containing explosions is the use of a "gravel gertie", such as developed by the Sandia Corporation in the 1950's to contain nuclear explosions. A gravel gertie is a dome-shaped gravel cover over an underground room used to assemble nuclear weapons. The gravel gertie is supported by steel cables strung from concrete walls surrounding the room. Layers of steel wire mesh are used to contain the gravel. If an accidental explosion in the room were to occur, the gravel roof would lift then fall back, filtering the nuclear material from escaping gasses and preventing them from entering the atmosphere.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION OF THE INVENTION

As indicated in the Background, gravel domes have been used as an architectural part of a ballistics containment building. The domes are designed into the building's structure, and conventionally the dome of gravel is piled on top of an underground room. The dome of gravel is designed to heave in the event of an energetic event, and to contain low-mass high-velocity fragments. Generally, massive relatively low-velocity fragments have not been a specific design criteria in the traditional gravel dome designs.

The invention described herein is directed to a containment system for a wide range of fragment sizes and velocities that may result from an explosion. The system is modular, so that containment rooms may be easily constructed and scaled to a size appropriate for the particular explosion threat. The modular design permits modules to be easily replaced.

Figure 1:
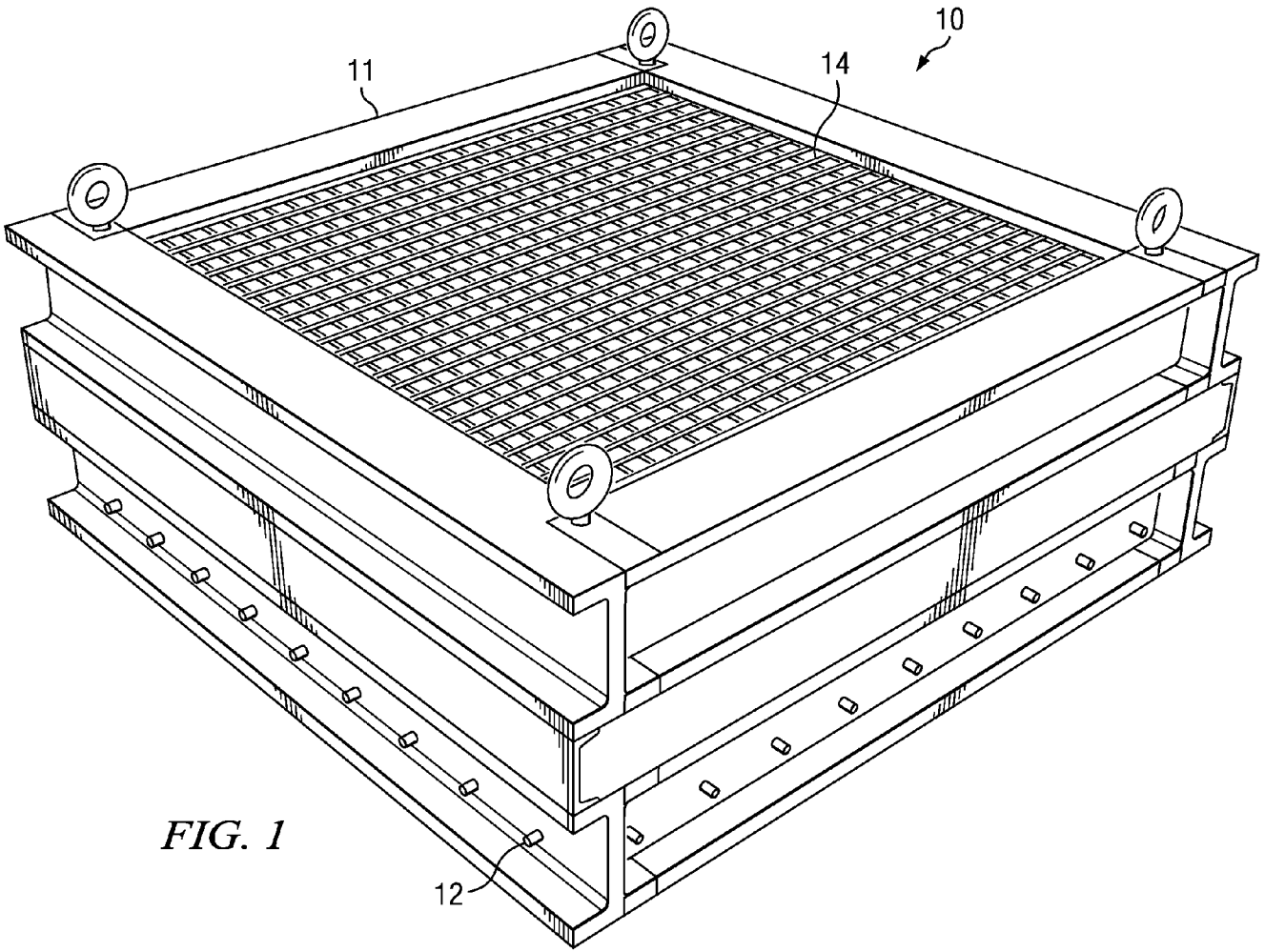
FIG. 1 illustrates a single module of the containment system.

FIG. 1 illustrates a single module 10 of the containment system. As explained below, each module 10 consists of a strong box frame 11, filled with graded and screened gravel sandwiched between layers of bridge strand and wire mesh. The gravel and the supporting strand and mesh are engineered to address specified threats (i.e. gas pressures, velocities, and masses).

As further explained below in connection with FIG. 2, a typical application of module 10 is to arrange a number of modules 10 in a tiled construction that serves as a roof and ceiling for a room in which there is danger of explosion. One example of such an application is a room that houses an industrial compressor such as those used in the oil and gas industry. Another example is a room in which weaponry is assembled or tested. For these applications, and others, a typical size of module 10 is 10×10 feet (a square rectangle in width and length) with a depth of 3-4 feet.

The outer box frame 11 is made from beams of rigid metal, or of some other material of comparable strength. An example of a suitable material for the frame 11 is steel I-beams. An I-beam has a strong central core capped with flanges on either side, and various lengths and ratings of beams are available. Steel is a typical material used to make I-beams, because it can withstand heavy loads, but other materials are sometimes used. Composite I-beams are also available.

Frame 11 may be made from materials other than I-beams. Regardless of the material used, frame 11 must support its own weight plus the loads of a small to nominal containment event without deforming or failing. If the containment loads are high, then the frame 11 may deform, in which case module 10 may be replaced. In general, frame 11 should be designed to meet the scope of the threat in terms of size, strength, and weight.

Figure 2:
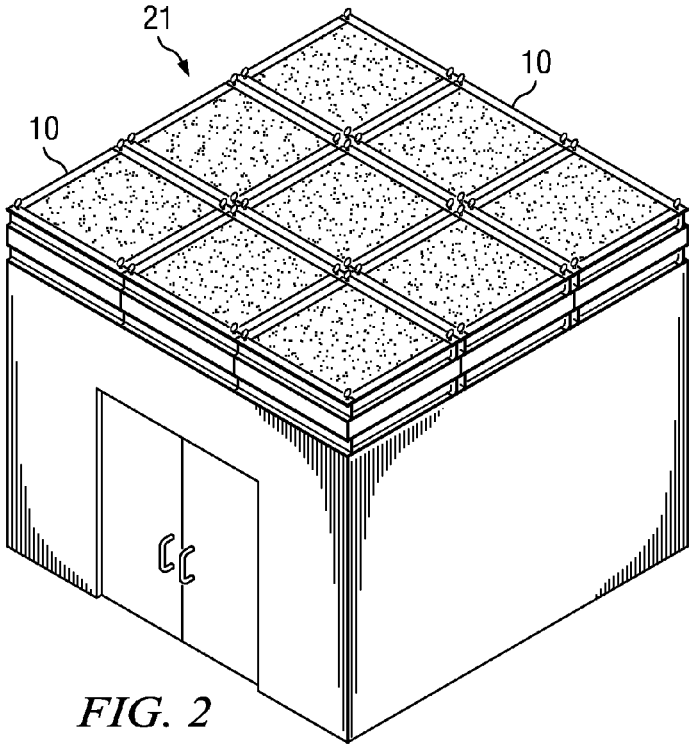
FIG. 2 illustrates a number of modules arranged in a tiled pattern to form a ceiling over a room in which there is a danger of explosions.

FIG. 2 illustrates a ballistic containment room (or other enclosed area), having a ceiling 21 comprising a tiled arrangement of modules 10. The modules 10 are supported by a structural "ceiling support grid" (not shown) across the top of the room 20, sufficiently strong to support the modules. The modules 10 need not be attached to each other or to their supporting grid, but may be laid atop the grid.

Alternatively, modules 10 may be bolted to the building, or a shock absorbing attachment means may be used between the edge modules and the rest of the building. Examples of simple shock absorbing attachment means are rubber or elastic isolators. More complex means may be used, such as tuned spring isolation systems or hammer shock pads. A module may be sandwiched between pads or isolators, one above and one below. If the module is impacted, an upper isolator absorbs energy and when the load is released, the lower isolator absorbs energy and holds the load.

The modules 10 need not be square in geometry, and may be any shape suitable for tiling as shown in FIG. 2. Alternative geometries could be rectangular, hexagonal, or cylindrical.

Modules 10 are designed to work in the vertical direction. It is possible to have them at a small angle without a design modification, but for use at large angles or vertically they would need to be redesigned with cubical cells which would contain the gravel.

Modules 10 operate by physically accepting the impact of a threat and dissipating the energy. Referring again to FIG. 1, various layers of cable and mesh are illustrated, which absorb explosive energy and contain the gravel. The explosive energy is transferred to the gravel, the bridge strand or cable, the module box, and eventually to the building structure. The building designers and engineers simply need to know the location of the attachment points and the maximum loads vertically upward and downward.

Figure 4:
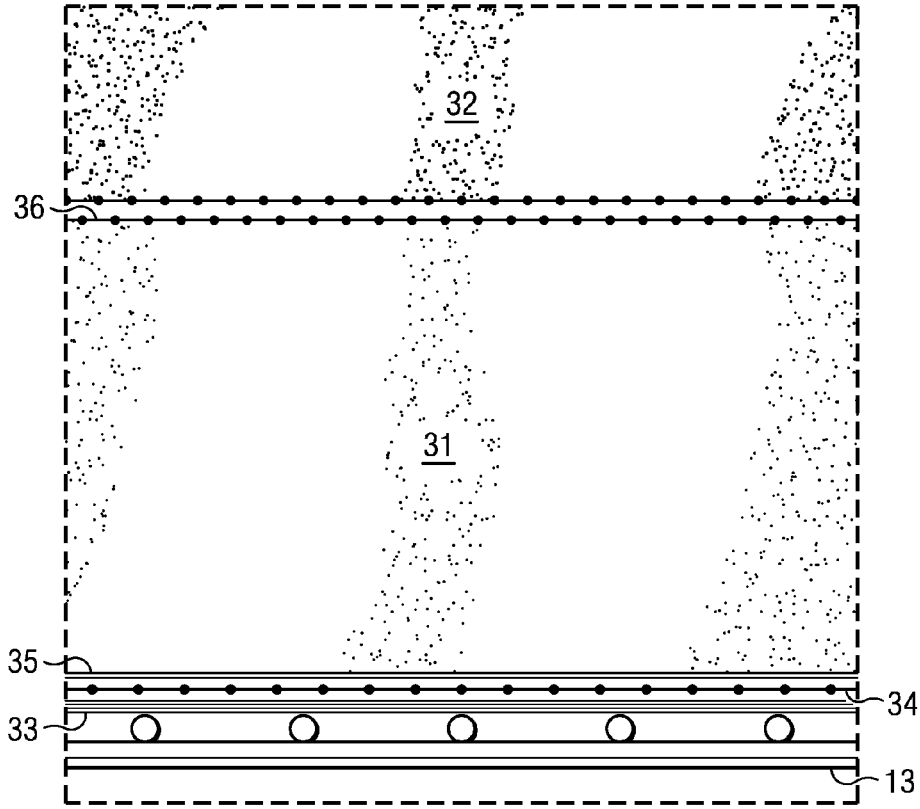
FIG. 4 is a more detailed view of a portion of the cross-section of FIG. 3.
Figure 3:
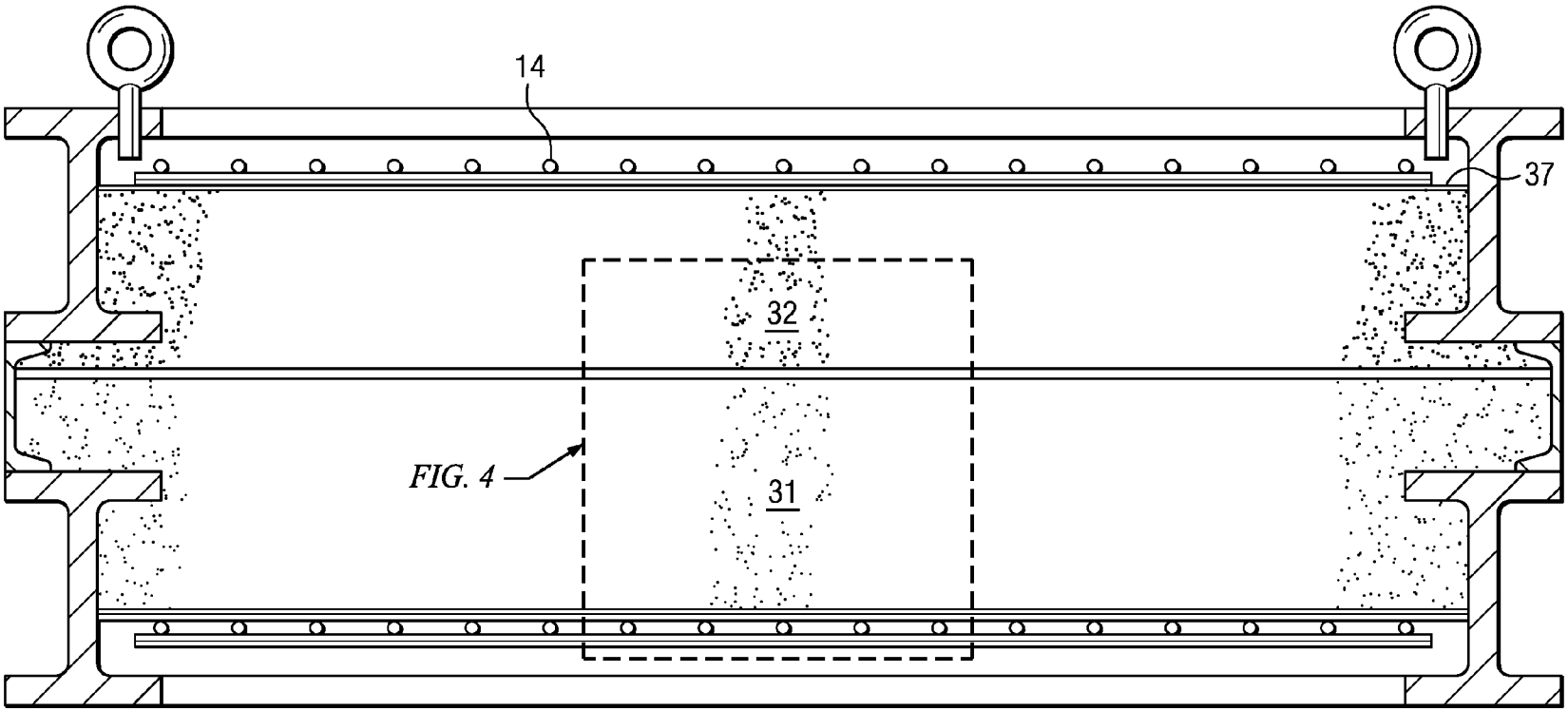
FIG. 3 is a cross sectional view of the module of FIG. 1.

FIGS. 3 and 4 illustrate the layers of cable and mesh for the example of FIG. 1, as well as the layers of gravel. There are two primary threats common to most energetic containment events: 1) gas pressure, and 2) ejected fragments. These threats are addressed by each module 10 in several ways: 1) Bridge cables (top and bottom), 2) screened gravel, 3) graded gravel, and 4) the frame.

The lower cables 13 are arranged in a criss-cross pattern and have two functions. One is to carry the load of the gravel. The second is to accept the impact loads of a large fragment (i.e. any object too large to pass between cables). The upper cables 14 carry the load of the gravel during an energetic event due to fragment impact and gas diffusion through the gravel. A typical material used for cables 13 and 14 is bridge strand.

Module 10 has two layers of gravel, each contained by wire mesh. The bottom layer of gravel 31 is screened gravel. The top layer of gravel 32 is graded gravel. In the example of this description, the gravel layers are approximately equal in depth, but their relative depths may vary. A typical range of sizes (diameter) for the screened gravel is from ⅜ inch to 2 inches. A typical range of sizes (diameter) for the graded gravel is 1 mm to 2 inches.

In an explosion, the force due to gas diffusion is primarily upward and is negligible horizontally because on average the horizontal forces will cancel each other leaving a pressure differential in the vertical direction (up) only. The screened gravel layer 31 is engineered to contain smaller fragments while allowing gasses to diffuse through the module 10. The depth of the screened gravel layer 31 is dependent on the threat. The graded gravel layer 32 is designed to contain larger fragments and provide weight to the module while further allowing gasses to diffuse through the module into the atmosphere above. Again the depth of the graded gravel layer 32 is dependent on the nature of the threat.

To contain and support the screen gravel, module has a "screen gravel support stack" of various layers. First, a first set of wire mesh layers 33 is laid over the lower cables 13. In the example of FIGS. 3 and 4, this first set of wire mesh layers 33 has four layers of wire mesh. Each wire mesh layer has 2×2 openings, and is made from welded wire fabric (wwf). Welded wire fabric is fabricated from a series of wires arranged at right angles to each other and welded at all intersections. A suitable welded wired fabric is made from W1.4 mesh where the "W" number indicates the size of the cross-sectional area of the wire in hundredths of an inch.

Immediately above the mesh layers 33 is a layer of mesh wire cloth 34. An example of a suitable material is No. 2 mesh, 18 gauge (approximately 0.048 inch diameter) wire cloth. A layer of felt 35 or closed material is placed atop the wire cloth layer 34. Any joints of the felt layer are mopped closed.

The screen gravel layer 31 is placed on top of the felt layer 35. The depth of layer 31 may very depending on the potential threat, its force, and size of exploding fragments.

Above the screen gravel layer 31 is a second set of wire mesh layers 36 of welded wire fabric. In the example of FIGS. 3 and 4, there are two layers of wire mesh, made from the same material as stack 33. The graded gravel layer 32 is placed above, and is supported by wire mesh layers 36.

To further contain the graded gravel, a third set of wire mesh layers 37 is placed above the graded gravel. As stated above, a criss-cross pattern of cables 14 (the upper cables) lies across the top of the box frame, over the wire mesh layers 37.

In sum, the gravel modules 10 address three threat categories: massive low velocity fragments, low mass high velocity fragments, and gas overpressure. Massive low velocity fragments are contained directly by the steel box frame, cables, and mass of the structure. Low mass high velocity fragments are contained by specified layers of both graded and screened gravel. Finally, overpressure due to the rapid expansion of gases is alleviated by diffusion due to the porosity of the gravel layers. The gravel will begin to heave and the load is taken by the upper wire mesh layers and bridge strand. Additionally, shockwaves are also diffused by the gravel layers.

What is claimed is:

1. A ceiling system for a room in which there is an explosion threat, and for containing fragments and for diffusing gases resulting from an explosion, the room having a ceiling support grid, comprising:

a tiled arrangement of gravel modules supported by the ceiling support grid;

wherein each gravel module comprises: a box frame, containing at least a bottom layer of screen gravel and a top layer of graded gravel;

a first crisscross pattern of bridge cable across the bottom of the box frame;

a screen gravel support stack above the first crisscross pattern of bridge cable, for supporting the screen gravel, the screen gravel support stack having a first set of layers of wire mesh, and at least one layer of closed material;

a graded gravel support stack above the screen gravel, for supporting the graded gravel, and having a second set of layers of wire mesh;

a third stack of wire mesh above the graded gravel; and a second crisscross pattern of bridge cable above the third set of layers of wire mesh and across the top of the box frame.

2. The system of claim 1, wherein the box frame is made from steel I-beams.

3. The system of claim 1, wherein the screen gravel has a particle size range of ⅜ inch to 2 inches.

4. The system of claim 1, wherein the graded gravel has a particle size range of 1 mm to 2 inches.

5. The system of claim 1, wherein the first set of wire mesh layers is made from welded wire fabric.

6. The system of claim 1, wherein the box frame is rectangular.

7. The system of claim 1, wherein the screen gravel layer and the graded gravel layer are approximately equal in depth.

8. The system of claim 1, wherein the screen gravel support stack further has at least one layer of wire cloth between the first set of layers of wire mesh and the closed material.

9. A method of containing fragments and diffusing gases resulting from an explosion in an enclosed area, comprising:

placing a tiled arrangement of gravel modules over the enclosed area;

wherein each gravel module comprises: a box frame, containing at least a bottom layer of screen gravel and a top layer of graded gravel; a first crisscross pattern of bridge cable across the bottom of the box frame; a screen gravel support stack above the first crisscross pattern of bridge cable, for supporting the screen gravel, the screen gravel support stack having a first set of layers of wire mesh, and at least one layer of closed material; a graded gravel support stack above the screen gravel, for supporting the graded gravel, and having a second set of layers of wire mesh; a third stack of wire mesh above the graded gravel; and a second criss-cross pattern of bridge cable above the third set of layers of wire mesh and across the top of the box frame.

10. The method of claim 9, wherein the box frame is made from steel I-beams.

11. The method of claim 9, wherein the screen gravel has a particle size range of ⅜ inch to 2 inches.

12. The method of claim 9, wherein the graded gravel has a particle size range of 1 mm to 2 inches.

13. The method of claim 9, wherein the first set of wire mesh layers is made from welded wire fabric.

14. The method of claim 9, wherein the box frame is rectangular.

15. The method of claim 9, further comprising the step of attaching the gravel modules at the edge of the enclosed area to the enclosed area with shock absorbing attachment means.

* * * * *